US005176559A

United States Patent [19]

Lane

[11] Patent Number: 5,176,559

[45] Date of Patent: Jan. 5, 1993

[54] TOY GLIDER

[76] Inventor: Stephen Lane, 102 Burlington St., Providence, R.I. 02906

[21] Appl. No.: 858,562

[22] Filed: Mar. 27, 1992

[51] Int. Cl.[5] ..... A63H 27/00

[52] U.S. Cl. ..... 446/35; 446/68; 446/61

[58] Field of Search ..... 446/34, 35, 61, 62, 446/63, 66, 68, 87, 88, 94, 230

[56] References Cited

U.S. PATENT DOCUMENTS

| | | | |
|---|---|---|---|
| 1,374,000 | 4/1921 | Dunn | 446/68 X |
| 2,282,764 | 5/1942 | Lazzari | 446/63 X |
| 3,187,460 | 6/1965 | Robertson | 446/61 |
| 3,576,086 | 4/1971 | Halsey | 446/68 |
| 3,858,350 | 1/1975 | Lux | 446/35 |
| 3,909,976 | 10/1975 | Kirk | 446/61 |
| 4,033,070 | 7/1977 | Strongin et al. | 446/68 |
| 4,109,411 | 8/1978 | Wetherell | 446/61 |
| 4,203,250 | 5/1980 | Garofalo | 446/61 |
| 4,253,897 | 3/1981 | Pistone | 446/34 X |
| 4,512,690 | 4/1985 | Johnson | 446/81 |

FOREIGN PATENT DOCUMENTS

| | | | |
|---|---|---|---|
| 2504814 | 11/1982 | France | 446/230 |

OTHER PUBLICATIONS

"Flaphappy Bird," Grape Nuts Flake box, Jul., 1949.

*Primary Examiner*—D. Neal Muir

*Attorney, Agent, or Firm*—Barlow & Barlow, Ltd.

[57] ABSTRACT

A toy glider is shown having a unitary wing formed of closed cell resin material disposed in a slot formed in a fuselage in which a weight is located to place the center of gravity of the glider at a point which, along with selected flexibility of the wing, produces a cyclical up and down flapping type of movement of the wings when placed in flight above a threshold velocity. The glider has no horizontal stabilizer and the fuselage has a force-receiving surface adapted to accommodate the distal portion of a person's finger.

8 Claims, 3 Drawing Sheets

TOY GLIDER

BACKGROUND OF THE INVENTION

This invention relates generally to toy gliders and more specifically, to such gliders which simulate the movement of birds by having wings which flap up and down.

Many different types of toy gliders have been designed over the years but none have successfully simulated the flapping movement of a bird's wings during flight. Typically, a toy glider or airplane has been formed of a fuselage with wings and stabilizers suitably mounted along with some type of ballast at a location selected to provide desired gliding characteristics. For example, as shown in U.S. Pat. No. 1,374,000, a pair of wings 12 are formed integrally with the fuselage section and are fixed by a bracing rod 22 which maintains the wings in a selected position.

More recently, with the availability of new materials, foam material has been used in various designs, thereby providing certain desirable attributes. Gliders formed of foam material are less likely to cause damage when striking objects than gliders formed of more rigid material and are particularly advantageous when used by young children. For example, gliders formed of foam material are shown in U.S. Pat. Nos. 3,576,086, 3,909,976, 4,033,070 and 4,512,690. While gliders made in accordance with the teachings of these patents provide enjoyable experiences for those who glide them, they all have wing surfaces which are essentially stationary relative to the main body or fuselage section.

It is an object of the present invention to provide a glider which simulates the movement of a bird in flight by having wings which flap up and down relative to the fuselage of the glider.

Another object is the provision of an inexpensive toy suitable for use by people of all ages, particularly young children, in which gliders can be flown for considerable distances with their wings flapping up and down.

Various additional objects and advantages of the invention will become readily apparent from the following detailed description and accompanying drawings.

BRIEF DESCRIPTION OF THE INVENTION

Briefly, in accordance with the invention, a unitary wing having an aspect ratio of approximately 4 or higher, is formed of closed cell resin material having a density within the range of approximately 2 to 5 lbs. per cubic foot. The wing is received in a straight slot formed in a fuselage preferably also formed of a foam material of any desired density. The planform shape of the wings is swept back with an angle between the lateral axis and a line formed by the leading edge of the wing between approximately 15° and 30°. A ballast is mounted in the fuselage at a location such that the center of gravity of the glider is located along the longitudinal axis approximately where the leading edge of the wing meets the fuselage. The weight of the ballast is sufficient, in combination with the weight of the remainder of the glider, to cause a deflection of the fuselage when the glider is supported at the wing tips in the at-rest condition so that a line formed between the wing tips and the root of the wings and the horizontal plane forms an angle between approximately 15 to 45 degrees. According to a feature of the invention, no horizontal stabilizer is employed. According to another feature of the invention, a force receiving surface is formed on the fuselage intersecting the longitudinal axis which in turn intersects the wing receiving slot.

BRIEF DESCRIPTION OF THE DRAWINGS

In the accompanying drawings, in which several of the preferred embodiments of the invention are illustrated.

Figure 1:
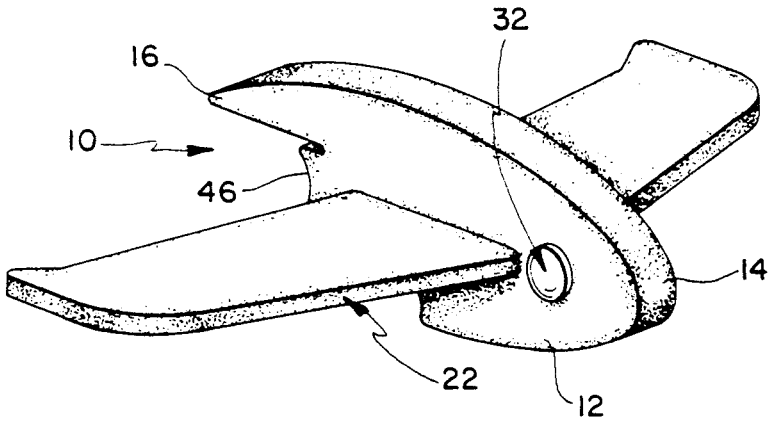
FIG. 1 is a perspective view of a glider made in accordance with the invention.
Figure 2:
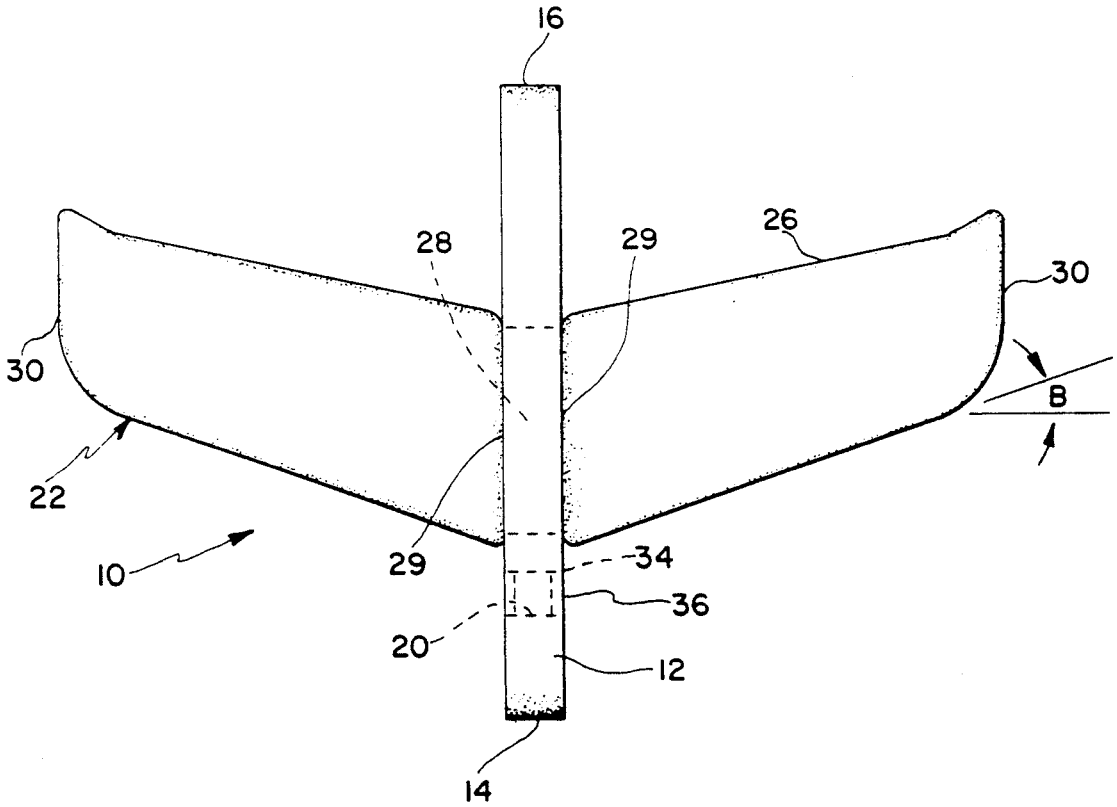
FIG. 2 is a top plan view of the FIG. 1 glider.

Dimensions of certain parts as shown in the drawings may have been modified or exaggerated for the purpose of clarity of illustration.

DETAILED DESCRIPTION OF THE PREFERRED EMBODIMENTS

With reference to the drawings, a toy glider 10 made in accordance with the invention comprises a fuselage 12 formed of suitable light-weight material such as closed cell cross-linked polyethylene having a nose portion 14, an aft portion 16 formed with a rectangular wing receiving slot 18, intermediate the nose and aft portions and a weight receiving bore 20 extending laterally through the fuselage intermediate wing slot 18 and nose portion 14.

A unitary wing member 22 is formed of a relatively stiff yet flexible closed cell resin material having a density approximately 2–5 lbs. per cubic foot. Wing member 22 has a leading edge 24, a trailing edge 26, a central portion 28 and wing tips 30. Preferably, the root sections 29 are formed with a chord slightly longer than the fore-aft distance of central portion 28 to facilitate maintaining the wing in its selected location. The aspect ratio of the wings, i.e. the distance between the tips of the wings or span divided by the average chord (MAC) or distance between the leading and trailing edges of the wing is at least approximately 4 or greater.

Figure 3:
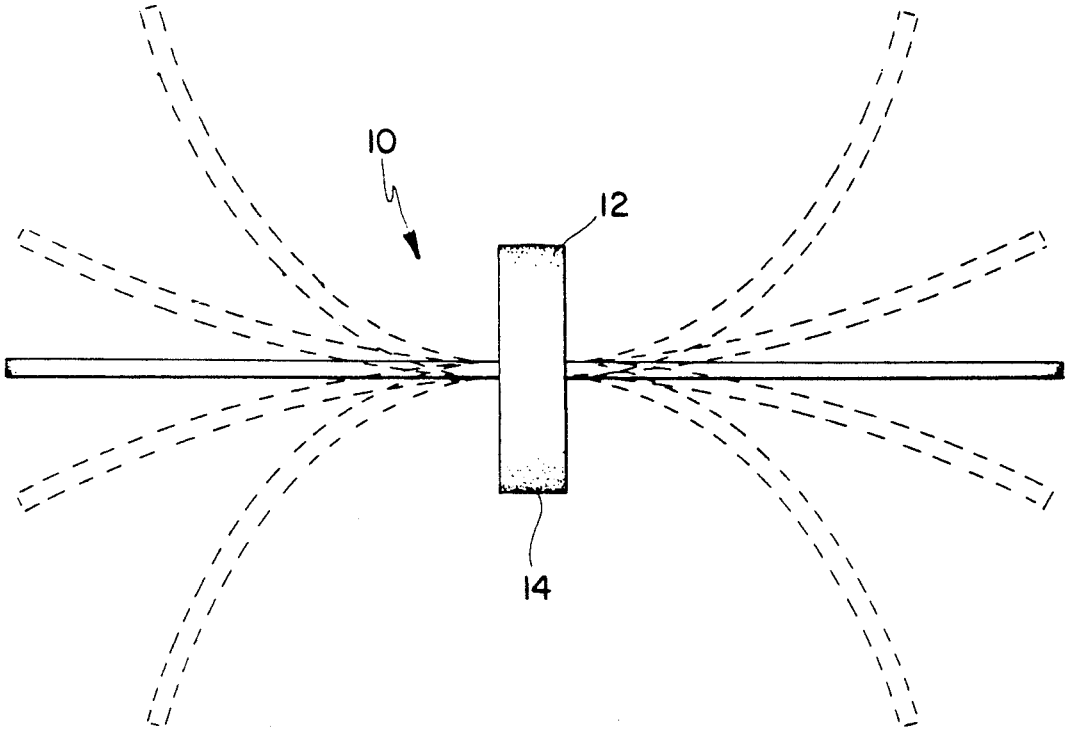
FIG. 3 is a front view of FIG. 2 showing in dashed lines various positions of the wings.
Figure 4:
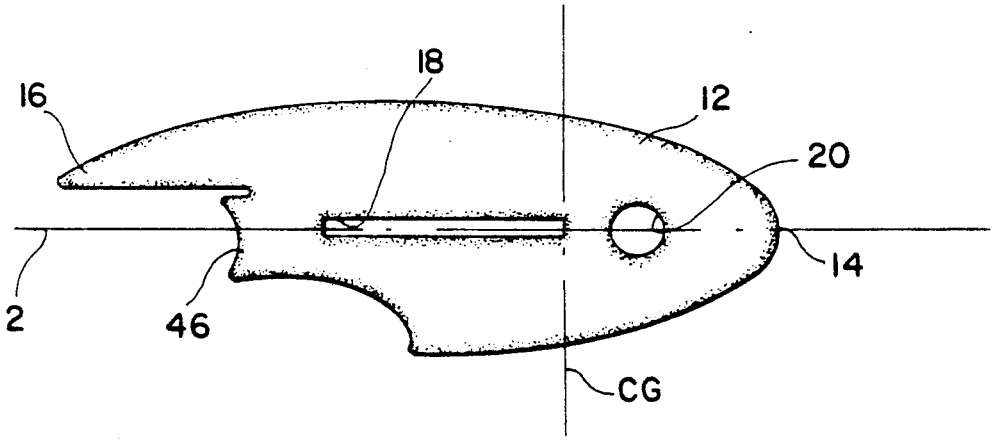
FIG. 4 is a side view of the fuselage of the FIG. 1 glider.

As best seen in FIGS. 3 and 4, the angle of incidence is neutral; however, it can be positive or negative and still operate with a flapping motion. The planform shape of the wings is swept back with an angle $\beta$ of between approximately 15° and 30° between the leading edge and the lateral axis.

Figure 5:
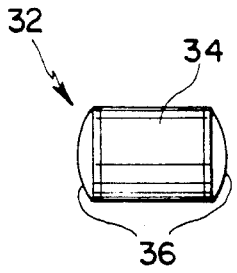
FIG. 5 is an enlarged front view of a ballast assembly used in a first embodiment of the invention.

Ballast means 32 is disposed in bore 20 and can take the form of any suitable weight which can be fixedly mounted in the bore. As seen in FIG. 5, a cylindrical rod 34 has a diameter selected to be tightly received in bore 20 and, if desired, may be fixed in the bore by means of a conventional glue. End caps of closed cell resin or other suitable material and of suitable decorative color may be fixed to the opposite end faces of rod 34 by suitable means such as conventional glue. The location of bore 20 and ballast 32 is selected so that the center of gravity of the vertical axis of the glider is at the leading edge of the root of the wings, within approximately ten percent of the length of the fuselage.

Figure 6:
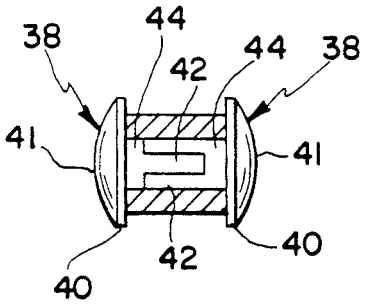
FIG. 6 is an enlarged front view of an alternative ballast assembly.

Alternatively, as seen in FIG. 6, ballast 32 can comprise a pair of interlocking pegs 38, each of which has a flange 40 with a diameter slightly larger than the diameter of bore 20 and intermeshing distal fingers 42 projecting from a base 44. A tubular member 43 of brass or other suitable material having an outer diameter approximately the same as that of bore 20 is received on fingers 42. If desired, glue can be used to insure that the ballast is permanently fixed in place. End buttons 41 of suitable material can be affixed to the outer face portions of flanges 38 for aesthetic purposes.

Figure 7:
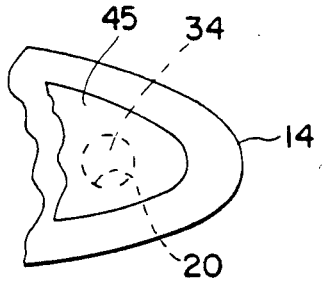
FIG. 7 is a side view of the nose portion of another alternative ballast assembly.

FIG. 7 shows another alternative embodiment in which rod 34 is placed in bore 20 and an outer layer 45 of foam or other suitable material having a selected decorative design is affixed as by gluing to each side of the fuselage capturing rod 34 within bore 20.

As shown in the drawings, the fuselage is a planar member having a tail section with no horizontal stabilizer. It has been found that a horizontal stabilizer inhibits the intended flapping operation of the wings. The particular configuration of the fuselage is not critical, various shapes can be used to suggest the shape of birds or even fish or the like. In the embodiment shown, the planar fuselage obviates the need of an additional vertical fin. While closed cell resin material is preferred for the fuselage, other light-weight materials such as balsa wood can be employed. Further, hollow, non-planar fuselages can also be employed. In such cases, it may be desirable to add a vertical fin in the tail section.

Fuselage 12 is preferably formed with a force receiving surface 46, which can conveniently be curved to facilitate reception of the distal portion of a person's finger as shown by the concave shaped surface in the drawing and preferably intersecting the longitudinal axis 2, also intersected by wing 22, so that one can grasp the fuselage with a finger on surface 46 and readily launch the glider in a forward direction with sufficient velocity to cause the wings to cycle between the dashed lines shown in FIG. 3, in effect changing the dihedral angle between the wings and a lateral plane. It has been found that a velocity in the order of 15 mph. is necessary to obtain the flapping operation of the wings, although this threshold level can be decreased with a downward snapping of the wrist upon launching.

Although the aeronautical explanation for the behavior of the wings is not fully understood, it is theorized that the combination of the incipient drag and turbulence of air caused by the somewhat rough surface of the foam wing, the location of the center of gravity of the leading edge of the root of the wing, the aspect ratio of the wings and the selected flexibility of the wing relative to the weight of the glider result in the flapping operation. As noted above, slot 18, which receives the wing, is rectangular so that when the wing is inserted it is essentially flat from fore-to-aft and that the resulting flexibility is determined solely by the shape of the wing and the characteristics of the material. That is, the glider seems to alternate between a stall condition with the nose up and wings lowered, and a recovery condition with the nose down and wings raised. It has been found that planform wing shapes having an aspect ratio less than approximately 4, such as the delta shape shown in U.S. Pat. No. 4,033,070, referred to supra, is unsatisfactory and does not produce the desired flapping operation.

Figure 8:
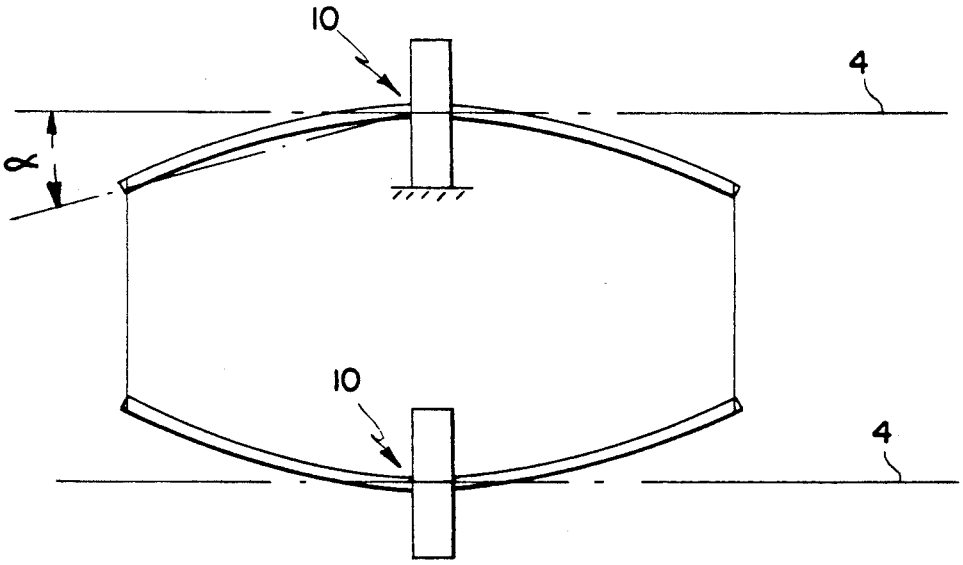
FIG. 8 is a front view of a test set up showing a pair of like gliders attached to one another at their wing tips to determine static wing deflection.

Other gliders having a wing span of up to two feet and as small as four inches have been made and operated in accordance with the invention. It has been found that the degree of flexibility of the wing in conjunction with the total weight of the glider is an important characteristic in determining whether a glider will perform with the desired flapping motion of its wings. A test procedure was developed to quantify this characteristic and is illustrated in FIG. 8. As showing in the figure, a first glider 10 is supported on a fixed surface and a second identical glider, i.e. a glider having the same weight, is suspended from the wing tips via lines, such as fishing lines, having insignificant weight and the angle $\alpha$ between a line extending form the wing tip to the root is then determined. Gliders of various types having wings with various aspect ratios, planforms and flexibility were tested and in all cases gliders which performed in accordance with the invention exhibited an angle $\alpha$ between approximately 15 and 45 degrees. It was also determined that for optimum performance the center of gravity CG was located approximately at the intersection of the root of the leading edge with the fuselage.

A glider made in accordance with FIGS. 1-4 and 6 of the invention had the following specifications:

| | |
|---|---|
| wing 22 | |
| span | 15 cm |
| MAC | 3.25 cm |
| aspect ratio | 4.6 approx. |
| weight | 6 g approx. |
| swept back | |
| angle $\beta$ | 19° |
| thickness | 3 mm approx. |
| cord at root | 37 mm approx. |
| cord adjacent | |
| wing tips | 29 mm approx. |
| material: | |
| cross-linked polyethylene | |
| closed cell foam having a | |
| density of 2-5 lbs. per $ft^3$ | |
| (Plastizote LD45) | |
| (available from British Petroleum) | |
| fuselage 12 | |
| length | 10.2 cm |
| width | 9.5 mm approx. |
| weight | 8 g approx. |
| material: | |
| cross-linked polyethylene | |
| closed cell foam a density of | |
| 2 lbs. per cubic foot (available from | |
| British Petroleum, Plastizote LD 45) | |
| ballast 32 | |
| member 43 weight | 26 g approx. |
| pegs 39 weight | 1 g each approx. |
| total | |
| weight | 42 g |
| angle $\alpha$ | 15° |

Gliders made in accordance with the invention which comprise both foam fuselage and wings are particularly suitable for use by young children being easily formed in the likeness of various birds or fish and being capable of flying up to 50 feet or more with minimal danger of damaging any objects they might hit.

Although the invention has been described with respect to specific preferred embodiments thereof, variations and modifications will become apparent to those skilled in the art. It is therefore the intention that the appended claims be interpreted as broadly as possible in view of the prior art to include all such variations and modifications.

I claim:

1. A toy glider having longitudinal, vertical and lateral axes comprising a fuselage portion having a forward nose portion and an aft tail portion and a wing receiving slot of a selected width extending through the fuselage portion;

a relatively stiff, flexible wing formed of a closed cell foam material having a density between approximately 2–5 lbs. per cubic foot and having an aspect ratio of at least approximately 4, the wing having a leading edge and being disposed centered in the slot with a left and a right wing portion extending laterally from the fuselage to a respective wing tip, a thickness selected so that there is a tight fit in the slot, the wing having sufficient flexibility to enable the dihedral angle which the left and right wing portions form with a lateral plane passing through the fuselage to change due to forces acting on the wing during flight so that the wing tip can assume different vertical positions relative to the fuselage, ballast means positioned in the fuselage such that the center of gravity of the glider is located in the fuselage at a point longitudinally approximately where the leading edge of the wing meets the fuselage, whereby upon receiving sufficient forward thrust to attain a velocity of at least approximately 15 mph., the glider will cycle between respective nose down, wing tips up and nose up, wing tips down positions simulating the action of a bird in flight.

2. A toy glider according to claim 1 in which the slot formed in the fuselage extends along a straight line.

3. A toy glider according to claim 1 in which the plan formed shape of the wings is swept back with the leading edge of the wing lying along a straight line which forms an angle with the lateral axes of between approximately 15° and 30°.

4. A toy glider according to claim 1 in which the wings have root contiguous with the fuselage and have a selected flexibility relative to the weight of the glider such that with the glider supported at the wing tips at an at-rest condition, the fuselage will deflect downwardly with a line drawn between the wing tip and the root forming an angle with a horizontal plane between approximately 15 and 45 degrees.

5. A toy glider according to claim 1 in which a force receiving surface is formed in the fuselage in line with the wing receiving slot.

6. A toy glider according to claim 5 in which the force receiving surface is concave as seen aft of the glider.

7. A toy glider according to claim 1 in which the wing is formed of closed cell cross-linked polyethylene foam having a density of approximately 2 pounds per cubic foot.

8. A toy glider according to claim 7 in which the wing has a span of approximately 15 cm, an aspect ratio of 4.6 and a weight of approximately 6 g and the fuselage has a weight of approximately 8 g and the ballast means has a weight of approximately 28 g.

* * * * *